US005167350A

United States Patent [19]

Amberg et al.

[11] Patent Number: 5,167,350

[45] Date of Patent: Dec. 1, 1992

[54] DETERGENT DISPENSING DEVICE

[75] Inventors: Guenther Amberg, Neuss; Heiner Brinkman, Hilden; Rolf Ullrich, Moenchengladbach, all of Fed. Rep. of Germany

[73] Assignee: Henkel Kommanditgesellschaft aut Aktien, Duesseldorf, Fed. Rep. of Germany

[21] Appl. No.: 613,519

[22] PCT Filed: Apr. 24, 1989

[86] PCT No.: PCT/EP89/00446

§ 371 Date: Nov. 2, 1990

§ 102(e) Date: Nov. 2, 1990

[87] PCT Pub. No.: WO89/10995

PCT Pub. Date: Nov. 16, 1989

[30] Foreign Application Priority Data

May 2, 1988 [DE] Fed. Rep. of Germany ..... 3814857
Sep. 19, 1988 [DE] Fed. Rep. of Germany ..... 3831778

[51] Int. Cl.[5] ..... B67D 5/58; D06F 39/02

[52] U.S. Cl. ..... 222/190; 222/185; 68/17 R; 134/93; 241/273.3; 241/60

[58] Field of Search ..... 222/190, 181, 185; 68/17 R; 134/93; 8/137; 312/42; 241/273.3, 280, 60

[56] References Cited

U.S. PATENT DOCUMENTS

| | | | |
|---|---|---|---|
| 2,483,161 | 11/1947 | Terzini | 241/273.3 |
| 2,489,081 | 11/1949 | Crichton | 241/273.3 |
| 2,948,437 | 8/1960 | Neilson | 222/196 X |
| 3,062,030 | 11/1962 | Groves | 68/17 R X |
| 3,178,915 | 4/1965 | Hertel | 134/93 X |

FOREIGN PATENT DOCUMENTS

| | | | |
|---|---|---|---|
| 20709 | 1/1985 | European Pat. Off. . | |
| 300819 | 1/1989 | European Pat. Off. | 222/190 |
| 203469 | 3/1908 | Fed. Rep. of Germany . | |
| 1265111 | 4/1968 | Fed. Rep. of Germany . | |
| 3721381 | 1/1989 | Fed. Rep. of Germany . | |
| 72992 | 9/1960 | France . | |
| 06199 | 2/1988 | World Int. Prop. O. | 68/17 R |

*Primary Examiner*—Andres Kashnikow
*Assistant Examiner*—Kenneth DeRosa
*Attorney, Agent, or Firm*—Ernest G. Szoke; Wayne C. Jaeschke; Kenneth Watov

[57] ABSTRACT

Detergent in block form can be fed in dosed amounts to the dispensing compartment of a washing machine if the particular detergent block is introduced into a magazine from which it can be fed to the washing machine via a size-reducing unit and optionally a dispersion unit.

8 Claims, 3 Drawing Sheets

DETERGENT DISPENSING DEVICE

BACKGROUND OF THE INVENTION

1. Field Of The Invention

The invention relates generally to a detergent dispensing device for a washing machine, and more particularly to such devices for initially accommodating detergent in block form, and removing the required amount from the blocks, and converting the same to a form more readily useable in a washing machine.

2. Discussion Of Related Art

German patent application P 37 21 381.4 describes a powder dispenser of a washing machine for portioning washing powder from an intermediate container into a dispensing compartment. This known dispenser is designed in such a way that it satisfactorily dispenses not only free-flowing detergent, but also detergent containing lumps and the like. To this end, the dispenser is provided with sufficiently large dispensing holes in the base of the intermediate container, a collecting plate fixed at a distance beneath each of the dispensing holes and a stripping mechanism. The stripping mechanism is designed to move in the space between the underside of the base and the collecting plates, and sweeps over substantially the entire plate surface.

In addition to the use of detergents in powdered, liquid or paste form, the possibility exists of using detergents in block form. Blocks can be produced in any desired shapes and dimensions, e.g., by casting. Considerable advantages result from handling detergent blocks, since on one hand blocks do not become dusty and cannot escape through holes, for example. Such detergent blocks also can be transported in packages that stack well. Competitive considerations also favor the shaping of the detergents in block form, since block-shaped detergents can be produced clearly differently from competitive products.

One problem in the use of detergent blocks is that the blocks can be dissolved only with the aid of large amounts of water and time, for rinsing into the washing machines. In EP-A 20,709, a distributing device for a cleaning agent existing in block form is described. With its casting mold still around it, the block is placed in the accommodation container provided for it, and water is allowed to flow around it for use.

An additional detergent dispensing device is known from WO 88/06199. With this device it is possible to supply detergent blocks of equal detergent quantities, held in portions in a reservoir container, to a washing machine. However, since these detergent blocks are conveyed to the wash water in the form of their intact units, they do not dissolve as rapidly as powdered detergents, and the high detergent concentration needed in a washing machine does not become established rapidly enough.

A detergent dispensing device of the initially indicated type is known from FR-A-72992. In this device, detergent blocks are finely divided and supplied in granular form to the wash water in washing machines.

SUMMARY OF THE INVENTION

One object of the invention is to provide an improved detergent dispensing device which is suitable for processing block type detergents, to obtain the highest wash liquor concentration desired in the wash program as rapidly as when powdered detergent is used.

Another object of the invention is to remove a portion of the detergent block, and thereafter dispense a predetermined amount of the detergent into the washing machine in a readily dissolvable form.

Another object of the invention is to ensure the detergent enters the rinse-in chamber of the machine in already partially or completely dissolved form.

These and other objects of the invention are accomplished in one embodiment of the invention by including a magazine for containing the block detergent, followed by a device for reducing the size of a block, and processing the removed portion for dispensing by a dispersing unit into the washing machine. In accordance with an embodiment of the invention, the size reduction device used is a mill, preferably a rasp disk suitable for the grinding of soap, with a drive motor actuated in accordance with the desired quantity to be added. One substantial advantage of this control method consists of the fact that the supply of finely divided detergent to the rinse-in chamber of the washing machine is performed precisely at the point of the product flow at which the block form, advantageous outside the machine, is converted into a fine particle form, advantageous inside the machine. It is also advantageous to dispense at the point where the block-shaped detergent is supplied in piece form to the size reduction device In the latter case, magazines are preferred in which the detergent blocks are present in sorted form, e.g., one on top of the other in a shaft, and are conveyed to the size reduction device with a slide or step switcher as needed. Finally, the magazine itself can also be advantageously equipped at its output, in a space saving way, with a size reduction device, so that ultimately the size reduction device is integrated into the magazine.

In an embodiment of the simplest type, the metering is regulated only through the drive power supplied to the size reduction device. In such an embodiment it may be sufficient to place the detergent blocks at the inlet site of a rasp or mill, and to drive this device at a speed such that precisely the desired amount of detergent in particle form per unit time is delivered to the rinse-in chamber of the washing machine.

BRIEF DESCRIPTION OF THE DRAWINGS

Various embodiments of the invention are described in detail below with reference to the accompanying drawings, in which like items are indicated by the same reference designation, wherein.

DETAILED DESCRIPTION OF THE INVENTION

Figure 1:
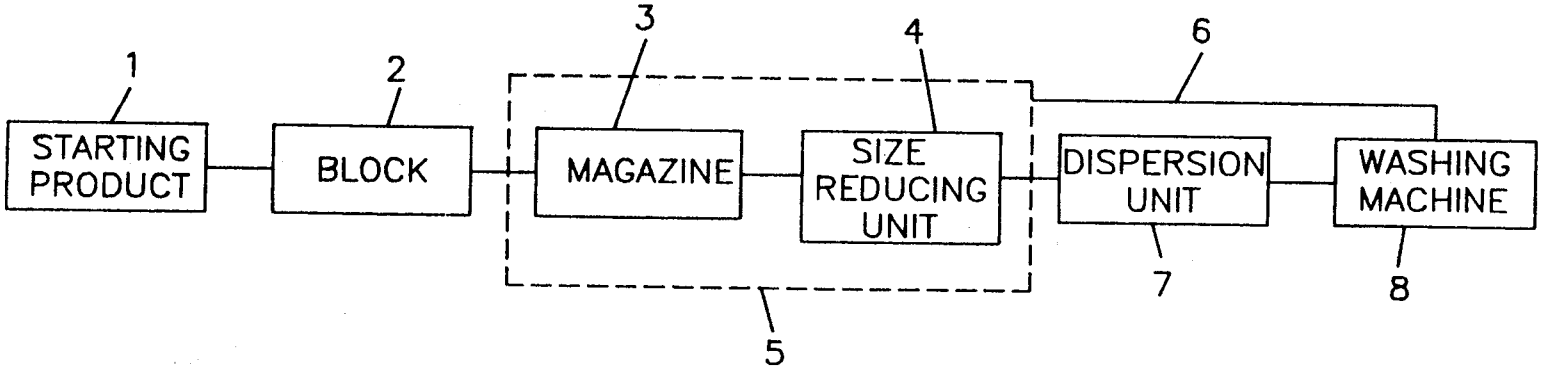
FIG. 1 is a block diagram of a dosing system for the use of detergent blocks.
Figure 2:
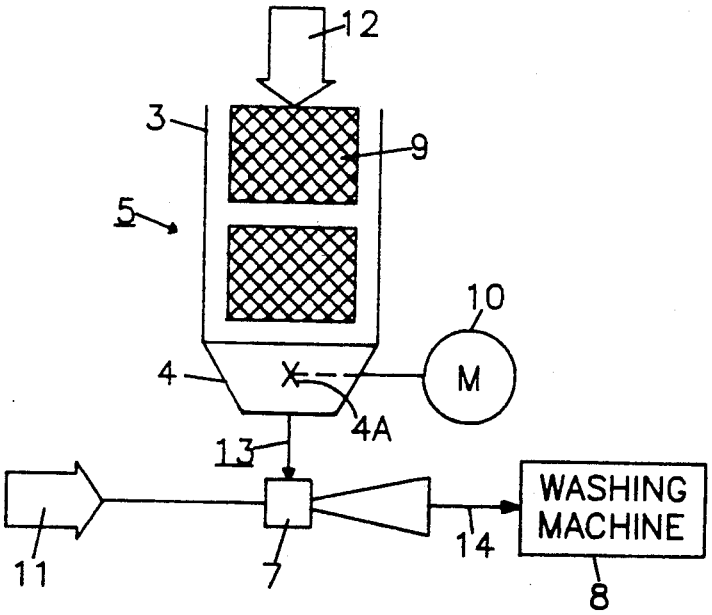
FIG. 2 is a basic illustration of the magazine, size-reducing unit and washing machine in that order.

FIG. 1 is a block diagram showing the successive stations involved in the manufacture and processing of detergent blocks 9 (see FIG. 2). The starting product 1 is made in the form of blocks 2 for transport, storage, etc. Accordingly, the detergent enters a magazine 3 in block form 9. From the magazine 3, the blocks 2 are transported into a mill or other sizereducing unit 4. The units 3 and 4 may be combined into a magazine mill 5. Any number, for example several days' rations, or detergent blocks 9 can be stored in the magazine 3. From the magazine 3, each individual block 9 passes into a size-reducing unit 4 where it is processed, for example by means of a grating disk or rasp 4A (see FIG. 2), into small chips that are easy to dissolve in the dispensing compartment of a washing machine 8. Depending on the formulation of the detergent blocks 9 or on the shape of the product chips, the detergent can be introduced into the dispensing compartment of a washing machine 8 either directly along the path 6 or via a dispersion unit 7. An injector or nozzle system is preferably used as the dispersion unit 7.

FIG. 2 shows the basic structure of a detergent dispenser according to the invention comprising a magazine 3 holding detergent blocks 9, a mill including a grating disk or rasp 4A designed to be driven by a motor 10, a dispersion unit 7 supplied with water 11 and the washing machine 8. The detergent blocks 9 are fed to the magazine 3 from above in the direction of the arrow 12, enter the dispersion unit 7 in finely divided form from the mill 4 in the direction of the arrow 13 and pass from the dispersion unit 7 in the direction of the arrow 14 into the dispensing compartment of a washing machine 8.

Within the context of the invention, the shape of the detergent blocks 9 is not of crucial importance. Cylindrical or rectangular bars, for example, are suitable. The blocks may weigh 50 to 5,000 g. depending on the capacity of the magazine mill 5 and on the demand of the following washing machine 8. The size of the detergent blocks 9 also depends on whether they are to be used in domestic or institutional washing machines.

Figure 3:
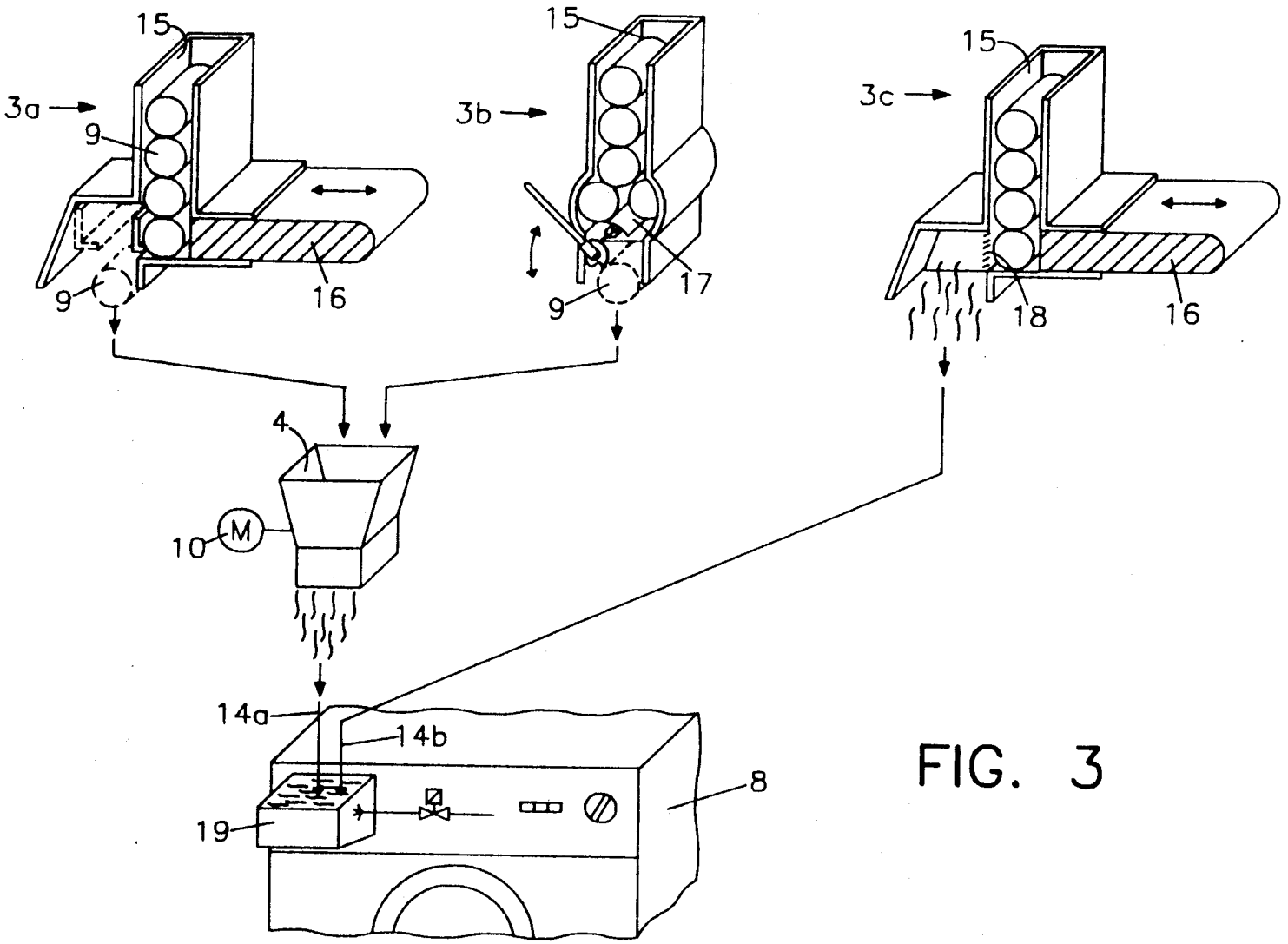
FIG. 3 shows exploded partial assembly views of various magazine and size-reducing systems at the entrance to the dispensing compartment of a washing machine.

FIG. 3 shows three different types of magazines 3*a*, 3*b* and 3*c*, for alternative embodiments of the invention, respectively. In all three cases, the detergent blocks 9 are arranged one above the other in a magazine duct 15. Laterally displaceable plungers 16 or metering wheels 17 may be used for dosing. Whereas the magazines 3*a* and 3*b* dose the next detergent block 9 to be introduced into a following size-reducing unit 4, the magazine 3*c* incorporates an integrated size-reducing unit, more particularly a size-reducing press 18, on the lines of a magazine mill 5 (FIG. 1). The size-reduced particles pass along the lines 14*a* and 14*b* to the dispensing compartment 19 of a washing machine 8.

The block dispenser according to the invention may be used both in domestic washing machines and in institutional laundries. In this case, as with known dispensers for powder-form or liquid detergent, several washing machines may even be connected simultaneously to one and the same dispenser consisting of a magazine 3, a mill 4 and, optionally, a dispersion unit 7 within an overall laundry control system. In addition, methods and machines of the type defined in DIN 24 100, Parts 1 and 2, may be used for size reduction.

Although various embodiments of the invention have been shown and described herein for purposes of illustration, they are not meant to be limiting. Certain modifications to these embodiments may be recognized by those of skill in the art, which modifications are meant to be covered by the spirit and scope of the appended claims.

We claim:

1. A detergent dispenser for a washing machine, comprising:

an intermediate container for holding a supply of detergent;

a dosing mechanism associated with said intermediate container for supplying detergent to a motor driven mill; and said intermediate container further including:

a magazine duct for holding or storing detergent blocks in a vertical stack;

said motor driven mill being located in one lowermost side wall portion of said magazine duct; and means located in another lowermost side wall portion of said magazine duct opposite said mill and associated one lowermost side wall, for forcing a lowermost one of said detergent blocks against said mill for grinding.

2. A detergent dispenser as claimed in claim 1, wherein the intermediate container is followed by a dispersion unit.

3. A detergent dispenser as claimed in claim 1, wherein said mill includes a grating disk.

4. A detergent dispenser as claimed in claim 1, wherein said intermediate container with detergent present in block form, includes means for feeding the detergent blocks to the motor driven mill by gravity.

5. The detergent dispensing device of claim 1, wherein said forcing means includes a displaceable plunger.

6. A detergent dispensing device for a washing machine comprising:

a magazine type storage container configured for accommodating a supply of detergent in block form;

a size reduction device attached to an outlet of said magazine, for receiving detergent blocks therefrom, said size reduction device including:

a motor driven mill selectively activated for mechanically reducing the detergent blocks into a quantity of smaller pieces or particles necessary for a desired dosage; and means located in a lowermost side wall portion of said magazine opposite said mill, for forcing a lowermost one of said detergent blocks against said mill for grinding; and a dispersing unit connected to an outlet of said size reduction device, for receiving the grounds of detergent from said size reduction device, and dispersing the same into the washing machine.

7. The detergent dispensing device of claim 6, wherein said mill includes a rasp disk driven by said motor.

8. The detergent dispensing device of claim 6, wherein said forcing means includes a displaceable plunger.

* * * * *